US012458181B2

(12) United States Patent
Wanninger et al.

(10) Patent No.: US 12,458,181 B2
(45) **Date of Patent: *Nov. 4, 2025**

(54) INSERT MODULE IN A DISPENSER

(71) Applicant: Essity Hygiene and Health Aktiebolag, Gothenburg (SE)

(72) Inventors: Dan Wanninger, Philadelphia, PA (US); Erol Searfoss, Philadelphia, PA (US); Peter Bergman, Gothenburg (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 251 days.

This patent is subject to a terminal disclaimer.

(21) Appl. No.: 18/009,732

(22) PCT Filed: Jul. 2, 2020

(86) PCT No.: PCT/EP2020/068636

§ 371 (c)(1),
(2) Date: Dec. 11, 2022

(87) PCT Pub. No.: WO2022/002401

PCT Pub. Date: Jan. 6, 2022

(65) Prior Publication Data

US 2023/0240481 A1 Aug. 3, 2023

(51) Int. Cl.
*A47K 5/12* (2006.01)
*A47K 5/16* (2006.01)

(52) U.S. Cl.
CPC ..... *A47K 5/1217* (2013.01); *A47K 5/1207* (2013.01); *A47K 5/16* (2013.01)

(58) Field of Classification Search
CPC ..... A47K 5/1217; A47K 5/1207; A47K 5/16; A47K 5/14
See application file for complete search history.

(56) References Cited

U.S. PATENT DOCUMENTS

| | | | |
|---|---|---|---|
| 5,625,659 | A | 4/1997 | Sears |
| 6,375,038 | B1 | 4/2002 | Daansen et al. |
| 7,757,567 | B2 | 7/2010 | Joyce et al. |
| 7,783,380 | B2 | 8/2010 | York et al. |

(Continued)

FOREIGN PATENT DOCUMENTS

| | | |
|---|---|---|
| CN | 2490103 Y | 5/2002 |
| CN | 1796249 A | 7/2006 |

(Continued)

OTHER PUBLICATIONS

Non-Final Office Action issued in U.S. Appl. No. 18/009,733; dated Jun. 30, 2023, 24 pages.

(Continued)

*Primary Examiner* — Bob Zadeh
(74) *Attorney, Agent, or Firm* — CANTOR COLBURN LLP

(57) ABSTRACT

The present disclosure relates to an insert module which is configured to be removably positioned in a dispenser for liquid, wherein the dispenser comprises a dispensing mechanism which causes liquid to be discharged, and wherein the dispenser is suited for comprising a replaceable liquid container for said liquid. The insert module is configured for accommodating said liquid container.

13 Claims, 8 Drawing Sheets

(56) References Cited

U.S. PATENT DOCUMENTS

| | | | | |
|---|---|---|---|---|
| 7,980,421 | B2 * | 7/2011 | Ophardt | A47K 5/1217 250/221 |
| 8,091,735 | B2 | 1/2012 | Girard et al. | |
| 8,201,707 | B2 | 6/2012 | Ophardt | |
| 8,240,508 | B2 * | 8/2012 | Wegelin | G05B 15/02 222/105 |
| 8,261,942 | B2 | 9/2012 | Chen | |
| 8,783,511 | B2 | 7/2014 | Snodgrass | |
| 8,905,265 | B2 | 12/2014 | Muderlak et al. | |
| 8,991,649 | B2 | 3/2015 | Wegelin et al. | |
| 9,443,357 | B2 | 9/2016 | Archer et al. | |
| 9,580,210 | B2 | 2/2017 | Wegelin et al. | |
| 9,993,120 | B2 | 6/2018 | Xie | |
| 10,057,709 | B2 | 8/2018 | Wegelin et al. | |
| 10,365,139 | B2 | 7/2019 | Singh et al. | |
| 10,460,549 | B2 | 10/2019 | Wegelin | |
| 10,464,091 | B2 | 11/2019 | Ophardt | |
| 10,614,699 | B2 | 4/2020 | Wegelin et al. | |
| 10,723,541 | B2 | 7/2020 | Akdogan et al. | |
| 10,929,794 | B2 | 2/2021 | Ghazi | |
| 10,996,690 | B2 | 5/2021 | Carlson | |
| 11,118,955 | B2 | 9/2021 | Wegelin | |
| 11,123,153 | B2 | 9/2021 | Davis et al. | |
| 11,131,575 | B2 | 9/2021 | Moore | |
| 11,181,413 | B2 | 11/2021 | Kobs | |
| 11,257,350 | B2 | 2/2022 | Liu et al. | |
| 11,259,671 | B2 | 3/2022 | Wegelin et al. | |
| 11,272,815 | B2 | 3/2022 | Rospierski et al. | |
| 11,295,271 | B2 | 4/2022 | Williams et al. | |
| 11,299,386 | B2 | 4/2022 | Slater et al. | |
| 11,882,968 | B2 * | 1/2024 | Wanninger | A47K 5/1207 |
| 2008/0283550 | A1 * | 11/2008 | Nighy | F04B 43/0736 222/207 |
| 2009/0195385 | A1 | 8/2009 | Huang et al. | |
| 2011/0017769 | A1 | 1/2011 | Ophardt | |
| 2011/0056987 | A1 * | 3/2011 | Proper | A47K 5/12 222/181.3 |
| 2011/0108410 | A1 | 5/2011 | Ophardt | |
| 2012/0245729 | A1 | 9/2012 | Wegelin et al. | |
| 2013/0020351 | A1 | 1/2013 | Pelfrey | |
| 2013/0282172 | A1 * | 10/2013 | Chen | A47K 5/1217 700/237 |
| 2015/0102056 | A1 | 4/2015 | Sage-Passant | |
| 2015/0223646 | A1 | 8/2015 | Wegelin et al. | |
| 2017/0014004 | A1 | 1/2017 | Bullock et al. | |
| 2017/0135530 | A1 * | 5/2017 | Macleod | G01F 23/263 |
| 2017/0136479 | A1 | 5/2017 | Ophardt et al. | |
| 2018/0199765 | A1 | 7/2018 | Wegelin et al. | |
| 2018/0265345 | A1 | 9/2018 | Marshall et al. | |
| 2019/0063980 | A1 * | 2/2019 | Kobs | G01F 11/003 |
| 2019/0197466 | A1 * | 6/2019 | Hand, III | G06V 20/00 |
| 2019/0254488 | A1 | 8/2019 | Tramontina | |
| 2020/0327520 | A1 | 10/2020 | Dyer | |
| 2021/0023577 | A1 | 1/2021 | Longarte Cifrián et al. | |
| 2021/0186274 | A1 | 6/2021 | Mechenbier et al. | |
| 2021/0401239 | A1 | 12/2021 | Buell et al. | |
| 2023/0214610 | A1 * | 7/2023 | Wanninger | G06K 7/10366 222/1 |
| 2023/0240481 | A1 * | 8/2023 | Wanninger | A47K 5/14 222/1 |

FOREIGN PATENT DOCUMENTS

| | | | |
|---|---|---|---|
| CN | 101861116 | A | 10/2010 |
| CN | 102238891 | A | 11/2011 |
| CN | 102858215 | A | 1/2013 |
| CN | 105395116 | A | 3/2016 |
| CN | 109091048 | A | 12/2018 |
| CN | 109890513 | A | 6/2019 |
| CN | 110035973 | A | 7/2019 |
| CN | 106605229 | B | 9/2021 |
| DE | 102018116204 | A1 | 1/2020 |
| EP | 3061374 | A1 | 8/2016 |
| EP | 3231339 | B1 | 10/2017 |
| EP | 3241470 | A1 | 11/2017 |
| GB | 2087839 | | 6/1982 |
| WO | 2006102263 | A2 | 9/2006 |
| WO | 2011133085 | A1 | 10/2011 |
| WO | 2017070401 | A1 | 4/2017 |
| WO | 2017188816 | A1 | 11/2017 |
| WO | 2018080545 | A1 | 5/2018 |
| WO | 2018224520 | A1 | 12/2018 |
| WO | 202071998 | A1 | 4/2020 |
| WO | 202138247 | A1 | 3/2021 |

OTHER PUBLICATIONS

Chinese Application No. 202080101594.9; Office Action with English translation dated Sep. 28, 2024; 13 pages.

U.S. Appl. No. 18/011,045; Non-Final Office Action dated Sep. 26, 2024; 31 pages.

International Search Report & Written Opinion for International Application No. PCT/EP2020/068636; International Filing Date: Jul. 2, 2020; Date of Mailing: Mar. 4, 2021; 11 pages.

International Preliminary Report On Patentability for International Application No. PCT/EP2020/068636; International Filing Date: Jul. 2, 2020; Date of Mailing: Sep. 30, 2022; 20 pages.

Chinese Application No. 202080101597.2; Chinese Office Action with English translation dated Mar. 15, 2023; 11 pages.

International Preliminary Report On Patentability for International Application No. PCT/EP2020/068637; International Filing Date: Jul. 2 202; Date of Mailing: Oct. 10, 2022; 18 pages.

International Search Report & Written Opinion for International Application No. PCT/EP2020/068634; International Filing Date: Jul. 2, 2020; Date of Mailing: Mar. 3, 2021; 154 pages.

International Search Report & Written Opinion for International Application No. PCT/EP2020/068637; International Filing Date: Jul. 2 202; Date of Mailing: Mar. 5, 2021; 9 pages.

Chinese Application No. 202080101590.0; Chinese Office Action with English translation dated Jan. 10, 2025; 23 pages.

Chinese Application No. 202080101594.9; Chinese Allowance with English translation dated Jul. 3, 2025; pp. 1-9.

* cited by examiner

INSERT MODULE IN A DISPENSER

CROSS REFERENCE TO RELATED APPLICATIONS

This application is a National Stage application of PCT/EP2020/068636, filed Jul. 2, 2020, which is incorporated by reference in its entirety herein.

TECHNICAL FIELD

The disclosure relates generally to liquid dispensers and more specifically to dispensers capable of dispensing liquid from a replaceable liquid container.

BACKGROUND

Dispensers for liquids such as soap and similar hygiene products are well known. The general purpose of such dispensers is to contain and dispense various types of liquid. Today's dispensers are used in homes, offices, hospitals, restaurants, airports and other types of environments. Furthermore, such dispensers may be arranged for dispensing different types of liquids such as soap, sanitizers, lotions, shampoo, skin care products or other types of liquids.

Furthermore, dispenser systems of the type which contain a dispenser and a replaceable liquid container are widely used. The use of a replaceable liquid container, for example for soap, allows users to replace an empty container with a new and full container in a simple manner.

A liquid dispenser system may comprise a dispenser with a housing which accommodates such a replaceable liquid container, which is also referred to as a "refill unit", or "refill cartridge". Such a liquid container is configured to be positioned inside a housing of the dispenser during use thereof. As the fluid is discharged from the liquid container, the remaining amount of fluid will gradually decrease. Eventually, the liquid container needs to be removed and replaced with a new one.

Furthermore, it is known to incorporate a pump unit, for example a foam pump unit, either in the replaceable liquid container or in the actual dispenser housing. Such a foam pump unit is previously known as such and is configured to transfer a liquid, such as soap, from the liquid container and discharge it out of the dispenser in the form of a foam. Other types of pump units exist, for example for discharging a liquid in the form of a spray, liquid or gel.

Some known soap dispensers have a replaceable liquid container that include an integrated foam pump. Such an arrangement has certain advantages. For example, it is a more hygienic solution than other systems, due to the fact that the liquid container is sealed. Such an arrangement also minimizes the likelihood of liquid leaking during replacement of the replaceable liquid container and reduces the number of required moving parts in the dispenser. In such systems, refilling can be made in a very simple manner by replacing an empty container with a full container.

Furthermore, a dispenser may be activated by a user by means of a suitable actuation device which can be either manual or automatic. A manual actuation device can for example be in the form of a push button or a lever which is arranged to activate a dispensing mechanism. Alternatively, an automatic actuation device can for example comprise a touch-free sensor device, such as an infrared sensor, which is configured to actuate an electric motor for operating a pump unit upon detection of the presence of a user.

Irrespective of which type of actuation device is used, the purpose of such a device is to allow a user to actuate the dispenser system so as to discharge a certain amount of the liquid (e.g., soap) which is contained inside the liquid container.

Known soap dispenser systems are sometimes provided with certain additional functions such as means for detecting the usage of the dispenser and also means for communicating with a central computer server. In this manner, data can for example be sent to maintenance staff in order to indicate that a replaceable liquid container needs to be exchanged for a new one.

Such new functions are not always compatible with all types of dispensers. In particular, certain dispensers are not always provided with electronic devices for identifying the liquid container which is used, for tracking the usage of the dispenser and for communicating with external devices. If, for example, there is a requirement for modernizing and upgrading a number of dispenser systems at a particular site such as an airport or a hospital, in order to allow tracking of the usage, each dispenser system will have to be replaced with a new one. This is of course costly and time-consuming work.

An example of an additional function which has been requested with regards to soap dispenser systems is the requirement to detect the usage of the dispenser, in particular with regards to the purpose of tracking the remaining contents of a replaceable liquid container. This is in order to determine when a liquid container is close to empty and for this reason should be replaced. It is of course desired that the container is used for as long as possible, i.e. it should not be replaced before it is empty, or close to empty.

To that end, it is known to arrange devices and methods by means of which the consumption of soap in a replaceable liquid container can be detected and analyzed. In particular, such systems may be provided with a detection unit for detecting the actual usage or alternatively the remaining volume of the liquid in the container, and also for transmitting signals to an external computer unit and further to maintenance service staff, in order to send instructions to exchange the empty container for a new one.

A further improvement in certain environments, such as hospitals and airports, where a large number of dispensers may be used and where there is a need to track the usage of each individual dispenser, is that each individual liquid container can be provided with a wireless transponder unit having stored information which corresponds to the identity of the liquid container in question. For example, a dispenser is known that comprises a replaceable cartridge with a transponder in the form of a communication tag, which may be in the form of a radio frequency identification ("RFID") tag. The dispenser also comprises an RFID antenna unit which is connected to a communication unit. The tag may comprise identity information which is associated with a unique cartridge and may also be used for detecting the usage of the cartridge. Furthermore, the dispenser is also arranged for communicating with an external computer server and for detecting whether maintenance is required when the cartridge is empty.

Features of the type described above cannot be used with all types of dispensers. The solution is then to replace them with entirely new dispensers with the necessary electronic equipment as described above, which may be costly.

It is also known to use various types of retrofitted electronic modules in order to convert and "upgrade" an existing dispenser system with a new function. For example, a wireless monitoring module may be installed in an existing hygiene dispenser, which may be either a manually operated or an automatically operated dispenser. This monitoring module may be configured for transmitting operational data of the dispenser to an external device.

While the monitoring module described above facilitates providing conventional dispensers with new electronic functions in a cost-effective and simple manner, there is still a desire for further improvements within this particular field of technology.

SUMMARY

In accordance with the disclosure, there is provided an improved insert module for a dispenser system.

In one embodiment, an insert module is provided that is configured to be removably positioned in a dispenser for liquid, wherein the dispenser comprises a dispensing mechanism which causes liquid to be selectively discharged, and wherein the dispenser is suited for comprising a replaceable liquid container for said liquid. Furthermore, the insert module is configured for accommodating said liquid container.

The insert module according to the disclosure has certain advantages. Firstly, it can be noted that the insert module can be retrofitted into an existing dispenser system in a simple manner in order to allow certain new functions to be implemented. In particular, the insert module can as such be provided with electronic devices which allow the use of new replaceable liquid containers, which are provided with transponder units, in a dispenser system which is not equipped with any transponder reader unit. The insert module may also include means for detecting the usage of the liquid in the liquid container.

The insert module may comprise a transponder reader unit for cooperating with a transponder unit on said replaceable liquid container.

The transponder reader unit may be configured to obtain stored data from said transponder unit corresponding to a unique identity of said liquid container.

The transponder reader unit may be an RFID reader unit and said transponder unit may be an RFID tag.

The insert module may comprise a detection unit which is configured for detecting the cumulative consumption of the contents of said liquid container, so as to indicate whether said liquid container needs to be replaced. This embodiment solves a problem which occurs when different users of the dispenser system use different amounts of liquid when the dispenser is actuated. Systems which simply count the number of actuations of the dispenser will not provide accurate measurements of the usage since different individual users can be expected to discharge different amounts of liquid.

The detection unit may comprise a magnetometer sensor.

The detection unit may be actuated by means of actuation means in said dispenser.

The detection unit may comprise an actuator which is configured for being pivotally displaced by means of said dispensing mechanism, thereby allowing detection of the usage of the contents of the liquid container.

The actuator may comprise a geared element which meshes with a gearwheel which is arranged in said insert module.

The transponder reader unit may be connected to a microprocessor which is arranged for communicating with an external computer unit.

The dispensing mechanism in specific embodiments comprises a foam pump unit for discharging liquid in said replaceable liquid container in the form of foam.

At least some of the advantages described above may also obtained by means of a method for using an insert module which is configured to be removably positioned in a dispenser for liquid. The method comprises providing a dispensing mechanism in said dispenser for causing liquid to be discharged; and providing a replaceable liquid container for said liquid in said dispenser. Furthermore, the method comprises accommodating said liquid container within said insert module.

Cooperation may be provided between a transponder reader unit arranged on the insert module and a transponder unit on said replaceable liquid container.

Stored data may be obtained from said transponder unit, by means of said transponder reader unit, corresponding to a unique identity of said liquid container.

A cumulative consumption of the contents of said liquid container may be detected by means of a detection unit; and an indication of whether said liquid container needs to be replaced may be provided.

The usage of the contents of said liquid container may be detected by allowing an actuator to be pivotally displaced by means of said dispensing mechanism.

Further advantages and advantageous features of the embodiments herein described are discussed in the following description.

In the following, the term "dispenser system" is used to indicate a combined apparatus comprising at least a dispenser and a liquid container. More precisely, as will be described below, the dispenser system is configured so that it may or may not include an insert module which as such is configured for accommodating the liquid container.

In the following, the term "insert module" is used to describe a device which is intended to be used for removably mounting inside the housing of an existing dispenser with the purpose of allowing certain functions and features to be added to said existing dispenser. In particular, the insert module is configured for accommodating a replaceable liquid container. Additional functions and properties can be added to the insert module, as will be described in detail below.

In the following, the term "replaceable liquid container" is used to indicate a container for a liquid such as soap and which is configured so as to be easily removed from the dispenser when it is empty, thereby allowing replacement with a new liquid container.

In the following, the term "transponder" is used to indicate an electronic device which uses electromagnetic radiation to receive and process an incoming signal and is configured to emit a response signal in response to the incoming signal. A transponder can be either an active or passive RFID tag or some other form of transponder such as a tag or label based for example on Bluetooth® or biometric technology, or similar.

In the following, the term "transponder reader unit" is used to indicate an electronic device which is configured for cooperating with one or more transponders in a manner so that data stored on said transponders can be read.

BRIEF DESCRIPTION OF THE FIGURES

The disclosure will be described in greater detail below with reference to the figures shown in the appended drawings.

DETAILED DESCRIPTION

Different aspects of the present disclosure will be described more fully hereinafter with reference to the enclosed drawings. The disclosure can be realized in many different forms and should not be construed as being limited to the embodiments below.

Figure 1:
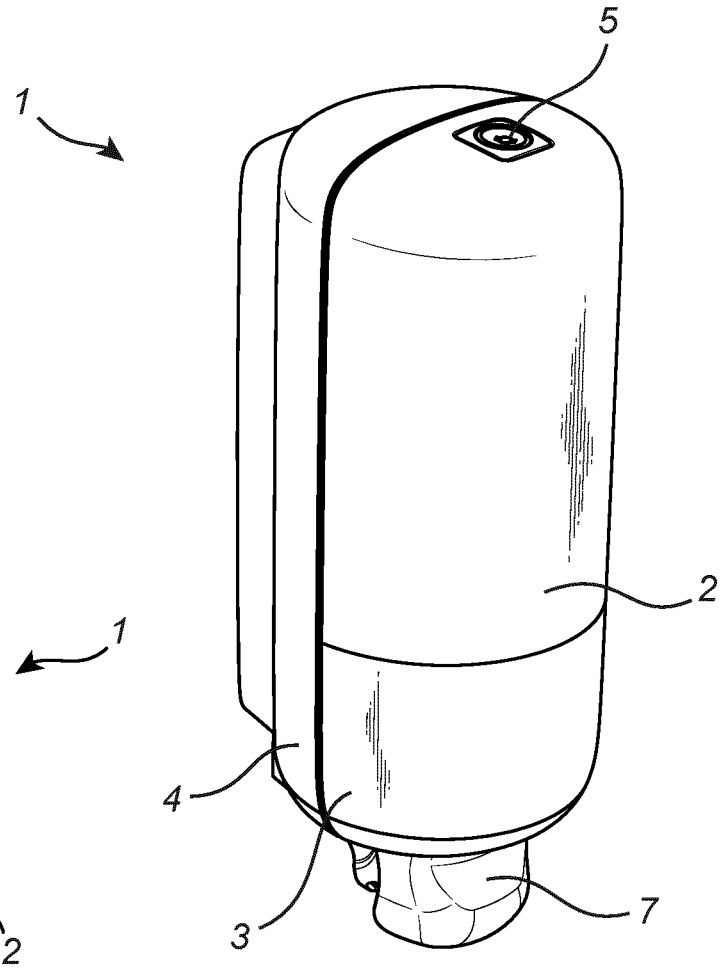
FIG. 1 shows a perspective view of a dispenser for liquids according to a first embodiment.

With initial reference to FIG. 1, there is shown a perspective view of a dispenser 1 for dispensing a liquid such as soap, for example. The dispenser 1 can alternatively be used to dispense other liquids such as a sanitizer, a lotion, a shampoo, a skin care product solution, a detergent, a disinfectant, a moisturizer, an alcogel or a similar liquid, or alternatively other fluids such as dispersions (for example an aerosol). According to what is known as such, the dispenser 1 is configured to discharge substances in the form of a fluid, a gel, a foam, a spray, or similar. Generally, the dispenser 1 is configured for placement in a location where the liquid is intended to be used, e.g. a bathroom, a hospital room, or a kitchen.

According to an embodiment which is shown in the drawings, the dispenser 1 is used for dispensing soap which is processed so as to be discharged as foam. To this end, the dispenser 1 can be actuated by means of a foam pump unit which is not shown in FIGS. 1 and 2 but which will be described below.

Figure 2:
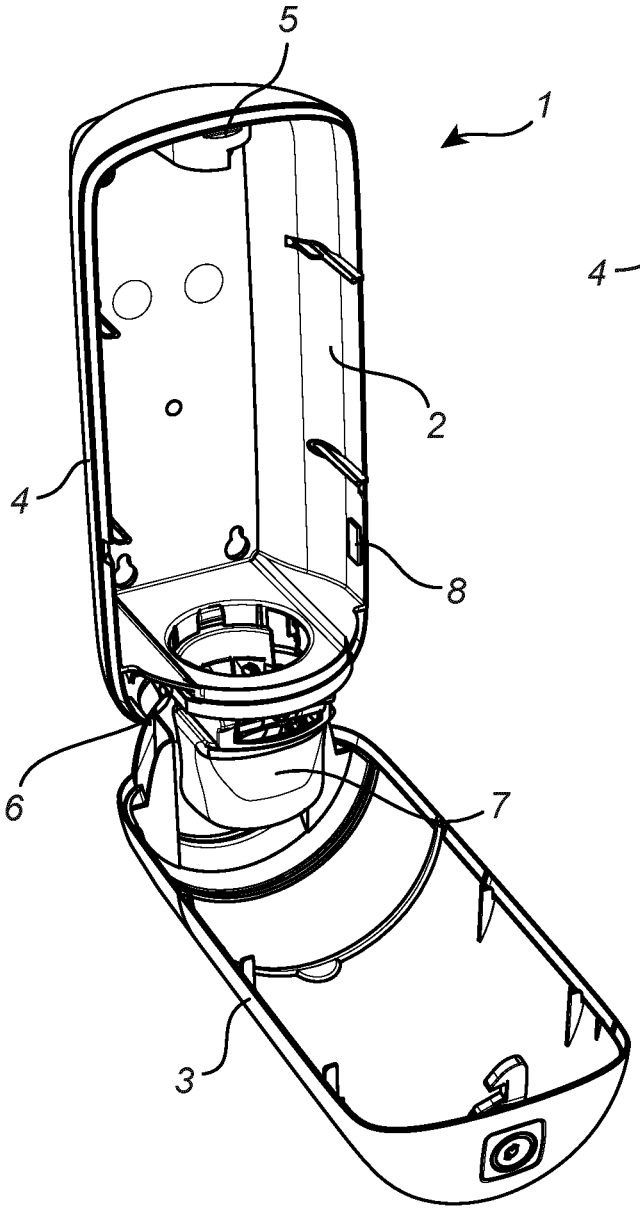
FIG. 2 shows a perspective view of the dispenser according to FIG. 1, in a condition in which a housing of the dispenser has been opened to allow access to the interior of the dispenser.

The dispenser 1 shown in FIGS. 1 and 2 comprises a housing 2 which is configured for containing a replaceable liquid container (not visible in FIGS. 1 and 2), also referred to as a replaceable refill unit. The housing 2 comprises a first portion 3 and a second portion 4 which are coupled to each other by a hinge and which can be locked together by means of a lock 5. Other fastening means between the first portion 3 and the second portion 4 are also possible. The first portion 3 corresponds to a front side of the housing 2 whereas the second portion 4 corresponds to a rear side of the housing 2 and which includes features for mounting the dispenser 1 on a wall or some other surface. The first portion 3 and the second portion 4 are suitably coupled by a hinge to one another along the bottom of the housing 2. This is shown in FIG. 2, in which it can be seen that the first portion 3 is pivotally arranged in relation to the second portion 4 via a hinge mechanism 6 in the form of a pivot joint or similar.

Other designs for opening the housing 2 are also possible within the scope of this disclosure. Furthermore, the housing 2 may be made of any suitable material, for example a plastic, a metal, or a combination thereof.

As mentioned above, the dispenser 1 is provided with an actuation device 7 which, in the embodiment shown in the drawings, is in the form of a manual push button. A user who wishes to discharge an amount of soap from dispenser 1 will have to push the actuation device 7, which causes discharging a liquid in a manner which will be described below.

According to an embodiment which is not shown in the drawings, the dispenser 1 can alternatively be provided with an automatic actuation device, which may comprise a touch-free sensor unit which may be based for example on an infrared sensor unit. Actuation of the sensor may cause an electric motor to be activated in order to operate the dispenser upon detection of the presence of a user.

Furthermore, the dispenser 1 is of the type which is provided with a transponder reader unit 8, i.e. an antenna unit or transponder detection unit which is arranged for detecting and cooperating with a transponder unit on a liquid container. The transponder unit will be described below with reference to FIG. 3. It should be noted that the disclosure is not limited to dispenser systems in which a dispenser 1 is provided with a transponder reader unit. In fact, as will be described below in detail, embodiments are contemplated in which a transponder reader unit can be positioned on a separate insert module which is configured for accommodating a replaceable liquid container.

Figure 3:
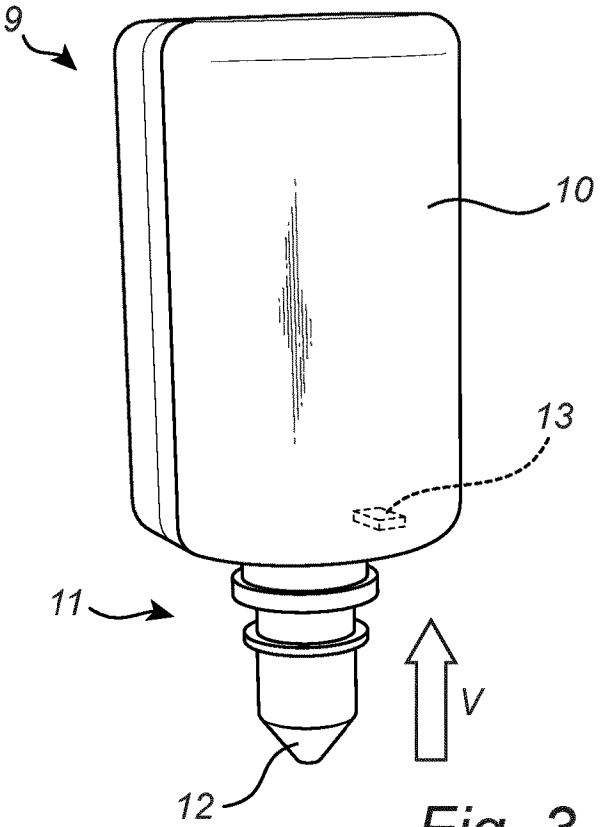
FIG. 3 shows a perspective view of a replaceable liquid container which is intended to be placed in the dispenser.

FIG. 3 shows a replaceable liquid container 9, also referred to as a "refill unit", which is intended to be used with the dispenser shown in FIGS. 1 and 2. The liquid container 9 is designed for storing and transporting liquid prior to use in the dispenser 1. The liquid container 9 is also designed to be inserted and fitted into the dispenser 1 for dispensing of the liquid. The liquid container 9 is designed to be used in dispensers of the type in which the dispensing takes place from the bottom of the dispenser. When the liquid container 9 is empty it may be removed and replaced with a new container.

As shown in FIG. 3, the liquid container 9 comprises a liquid reservoir 10 and a dispensing mechanism in the form of a pump unit 11 which is connected to and ends with a dispensing opening 12. The liquid reservoir 10 is the portion of the liquid container 8 in which liquid is stored. In FIG. 3, the liquid reservoir 10 is shown as having a generally cylindrical form, but other three-dimensional forms are also possible. The reservoir 10 is consequently hollow, and is made of a material which is suitable for the liquid contained therein, without degradation of the liquid or the liquid reservoir 10. For example, and without limitation, suitable materials for the liquid reservoir 10 include plastics, such as polyethylene or polypropylene.

Furthermore, the liquid container 9 comprises a pump unit 11 which acts to transfer liquid from the liquid reservoir 10 and to selectively dispense same. To this end, the liquid reservoir 10 is connected via the pump unit 11 to the dispensing opening 12 through which the liquid is discharged. A pump unit 11 for a liquid dispenser of the kind mentioned above is previously known as such from the patent document WO 2011/133085. For this reason, the pump unit 11 is not described in any greater detail here.

However, it should be mentioned that activation of the pump unit 11 by displacing its lower portion upwards, i.e. in a first generally vertical direction (arrow V), discharges a quantity of liquid from the liquid reservoir 10 via the dispensing opening 12. As illustrated in FIG. 3, the pump unit 11 is located at one end of the liquid reservoir 10, and—in this particular embodiment—the first direction (arrow V) generally corresponds to an extension of the axis of the cylindrical liquid reservoir 10.

As mentioned above, the liquid container 9 may contain, for example, a sanitizer, lotion, shampoo, skin care product, detergent, disinfectant, moisturizer, alcogel or a similar liquid, or alternatively fluids such as dispersions. Also, the contents of the liquid container can be discharged in many forms, suitably but not limited to foam, spray, gel, lotion or similar. Different types of contents in the liquid container and different methods of discharging said contents may require different types of pump units, which are adapted to the contents of the liquid container. This means that the disclosure is not limited to dispenser systems with a pump unit as described with reference to FIG. 3 but can be implemented with other types of pump units. In fact, an example of an alternative type of dispensing mechanism unit is disclosed in the patent document WO 2017/050390.

Figure 4:
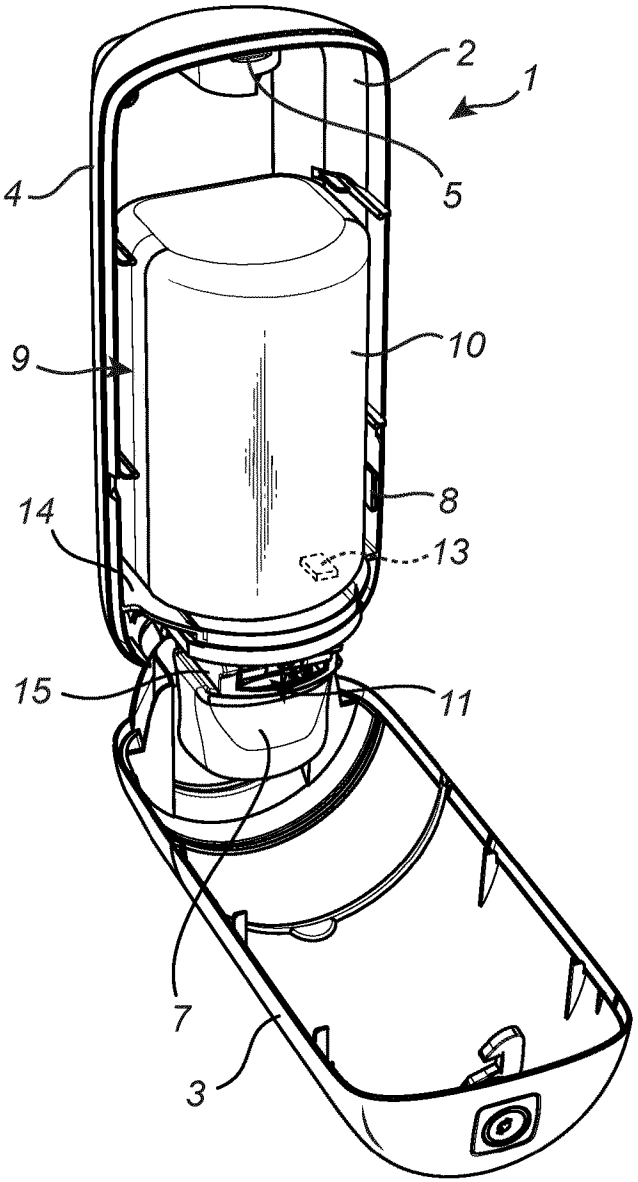
FIG. 4 shows a dispenser system with a dispenser, in a view corresponding to FIG. 2 but including a replaceable liquid container which is positioned in the dispenser.

FIG. 4 shows a dispenser system comprising the dispenser 1 and the liquid container 9, in an operating mode with the housing 2 in an open condition. When the first portion 3 is closed, the dispenser 1 is ready to be used. As shown, the dispenser 1 is provided with the replaceable liquid container 9, i.e. in a condition in which the container 9 is positioned inside the housing 2. In this condition, the liquid container 9 rests upon a bottom surface 14 in the housing 2 and is disposed such that the pump unit 11 extends downwards through an opening 15 in said bottom surface 14. Also, the pump unit 11 is positioned behind the actuation device 7 so that it may be activated mechanically by means of the actuation device 7 when a user wishes to dispense soap. More precisely, and with further reference to FIGS. 5A and 5B, which show a side view of the replaceable liquid container 9 with the actuation device 7 shown in cross-section, it should be noted that the actuation device 7 is pivotable about a pivoting axis 16 in the dispenser 1. Also, the actuation device 7 comprises an actuator surface 7*a*, which is configured so that a user may push on it, and a pump actuator 7*b*, which is located below an annular flange 17 extending around the pump unit 11 when the actuation device 7 is in a stand-by condition.

Figure 5B:
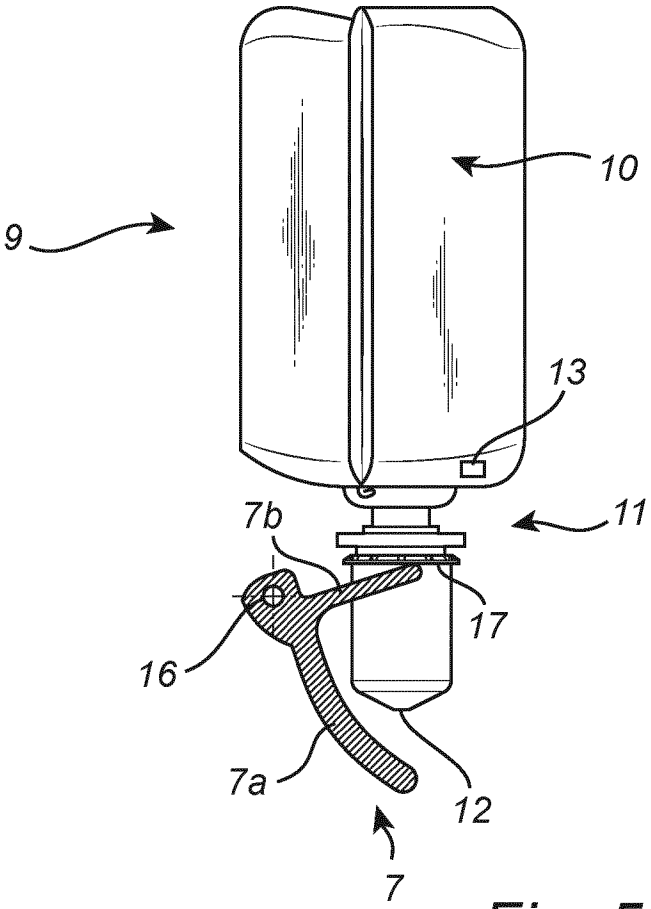
FIG. 5B shows a replaceable liquid container and the operation of an actuating unit, in a second condition.
Figure 5A:
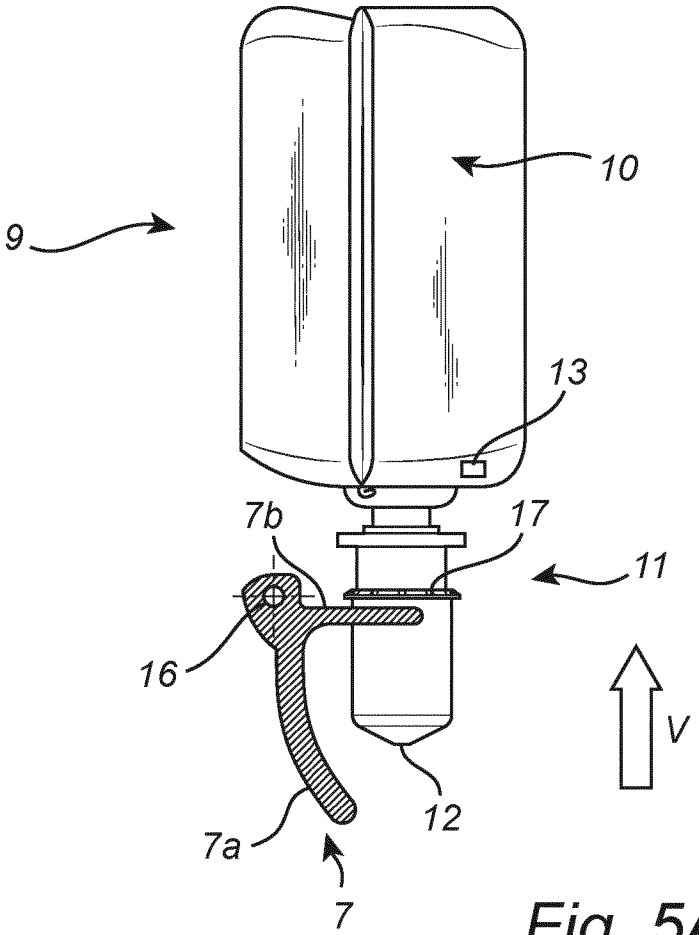
FIG. 5A shows a replaceable liquid container and the operation of an actuating unit, in a first condition.

In a first position, shown in FIG. 5A, the actuation device 7 is in a pivotal position in which it is accessible to a user. When the user pushes on the actuator surface 7*a*, the actuation device 7 will pivot in a counter-clockwise direction. This rotation makes the pump actuator 7*b* move so as to force the flange 17 in an upwards direction (i.e., the direction indicated by arrow V in FIG. 5) so as to actuate the pump unit 11. In a second position, shown in FIG. 5B, the pump actuator 7*b* has reached a pivotal position in which the flange 17 has been forced to an upper position which corresponds to a condition in which contents of the liquid container 9 have been pumped out via the dispensing opening 12.

It is previously known, for example through the above-mentioned document WO 2011/133085, how an actuation device as shown in for example FIGS. 5A and 5B can be operated to actuate a pump unit.

The replaceable liquid container 9 is arranged with means for storing unique identification data related to said liquid container 9. As indicated in FIGS. 3, 4, 5A and 5B, the liquid container 9 is provided with an electronic transponder 13 which can be pre-programmed with data indicating a unique data code which corresponds to the identity of each individual container 9. In one embodiment, the transponder 13 is suitably positioned on or close to a bottom outer surface of the liquid container 9 (see for example FIG. 4). Alternatively, the transponder 13 can be embedded within the material from which the liquid container 9 is formed.

A particular type of known transponder which is suitable in the context of this disclosure is an RFID transponder, also referred to as an "RFID tag." The RFID transponder is normally designed as a tag or a label comprising an antenna component which receives the incoming signal, a processor component which processes the incoming signal and also transmits the outgoing signal via the antenna component.

An RFID transponder can be programmed with data representing the transponder's unique identity. Accordingly, the RFID transponder 13 shown in the illustrative embodiment in the drawings is programmed with data indicating the identity of a corresponding liquid container 9 to which the RFID transponder 13 is attached. This means that already during manufacturing of each liquid container 9, its unique identity is stored in the attached RFID transponder 13.

The RFID transponder 13 can be either passive (i.e., not requiring a power source) or active (i.e., comprising a power source). Also, in addition to data representing the actual identity of a particular liquid container, the RFID transponder 13 can be programmed with data representing for example the type of liquid stored in the liquid container 9 and the total amount of liquid stored in the liquid container 9. Also, the RFID transponder 13 may comprise data representing the date of manufacturing of the liquid container 9, or a suitable size of a soap dose which can be dispensed, or other types of data related to the liquid container and/or its contents.

In other contemplated embodiments, the transponder 13 can be of another type, such as an optically readable barcode or a tag or label based on Bluetooth® technology, for example.

Figure 6:
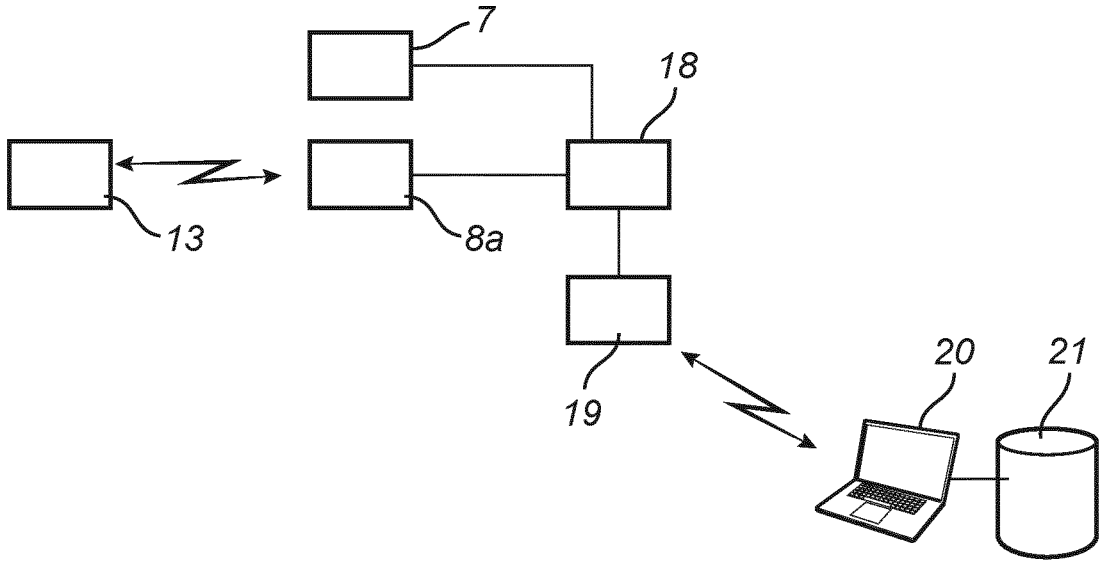
FIG. 6 is a schematic drawing of a system for detection of the consumption of the liquid container.

Furthermore, data being associated with the transponder 13 can be detected and read by means of the transponder reader unit 8 which is shown in FIGS. 2 and 4. To this end, the transponder reader unit 8 is arranged for transmitting an interrogation signal to the transponder 13. Such an interrogation signal can for example be issued in order to request data from the transponder 13 representing the identity or type of liquid in the liquid container 9. A response signal emitted by transponder 13 is received and stored by transponder reader unit 8. With reference to FIG. 6, that figure schematically shows a system for transmitting data to and from the dispenser 1. The system is based on a microprocessor 18 which is connected to the transponder reader unit 8 and also to the actuation device 7. For this purpose, the actuation device 7 is provided with a electrical switch or detector (not shown) which is configured for generating an activation signal and transmitting said activation signal to the microprocessor 18 each time a user actuates the dispenser 1 by pushing on the actuation device 7.

An interrogation signal from the microprocessor 18 to the transponder 13 is suitably transmitted from the transponder reader unit 8 when a user pushes on the actuation device 7. The signal is transmitted to the transponder 13, which in turn generates a response signal including data which represents the actual identity of the transponder 13. This response signal is forwarded to the microprocessor 18. This can be carried out at specific point in time or at a certain frequency, or when the actuation device 7 transmits an activation signal indicating that dispensing has been initiated.

The information which has been collected by the microprocessor 18 can subsequently be forwarded to a communications unit 19 which is configured for transmitting data to an external computer unit 20 which is configured for processing the incoming data. According to an embodiment, the communications unit 19 comprises a radio transceiver which is arranged for providing two-way radio communication with the external computer unit 20. A computer memory unit 21 such as a database is suitably connected to the external computer unit 20.

In one embodiment, the RFID transponder 13 only contains information regarding the unique identity of a liquid container 9. During an interrogation situation, data related to the identity of the liquid container 9 is transmitted to the external computer 20, which fetches relevant data regarding the liquid container 9 and its contents from the database 21. Such relevant data may comprise information regarding the container's 9 identity and the accumulated amount of travel of the pump unit 11. Based on such relevant data, information regarding for example a suitable time to replace the liquid container 9 can be forwarded to cleaning staff.

Consequently, the external computer unit 20 may send information to cleaning staff related to the liquid level of the liquid container 9, or alternatively whether a particular liquid container 9 has passed its "best if used before" date, or whether a liquid container 9 needs to be replaced due to quality reasons, for example.

In summary, the dispenser 1 is to house the replaceable liquid container 9, which is provided with a unique identity and which also carries a transponder unit 13 with stored identification data representing the identity of the liquid container 9. In a specific embodiment, the dispenser 1 comprises a transponder reader unit 8 that cooperates with the transponder unit 13 and which is also configured for communicating with an external computer unit 20. Also, the dispenser 1 is configured to detect the usage of the liquid container 9 so as to indicate whether the liquid container 9 needs to be replaced.

Figure 7:
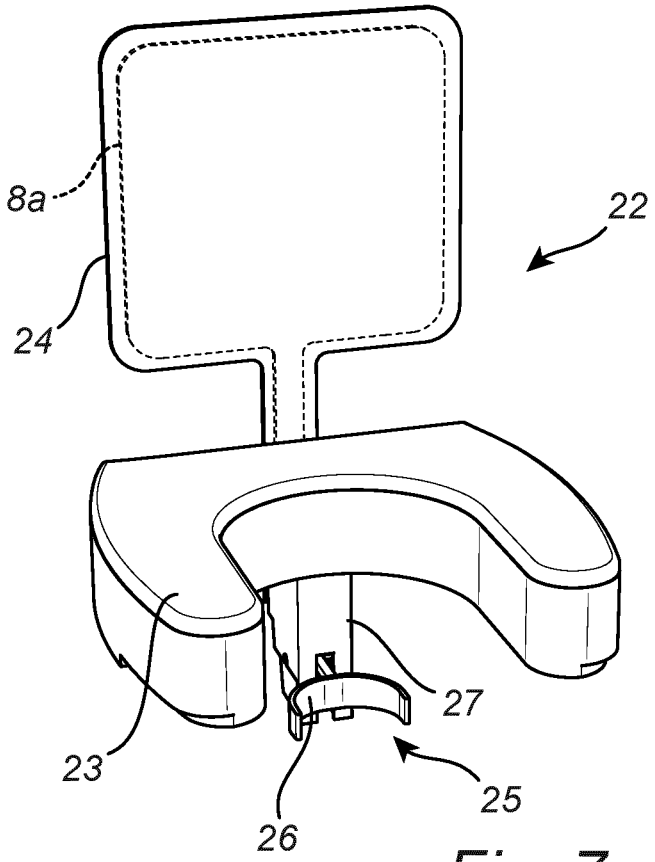
FIG. 7 shows an insert module in accordance with the disclosure.
Figure 8:
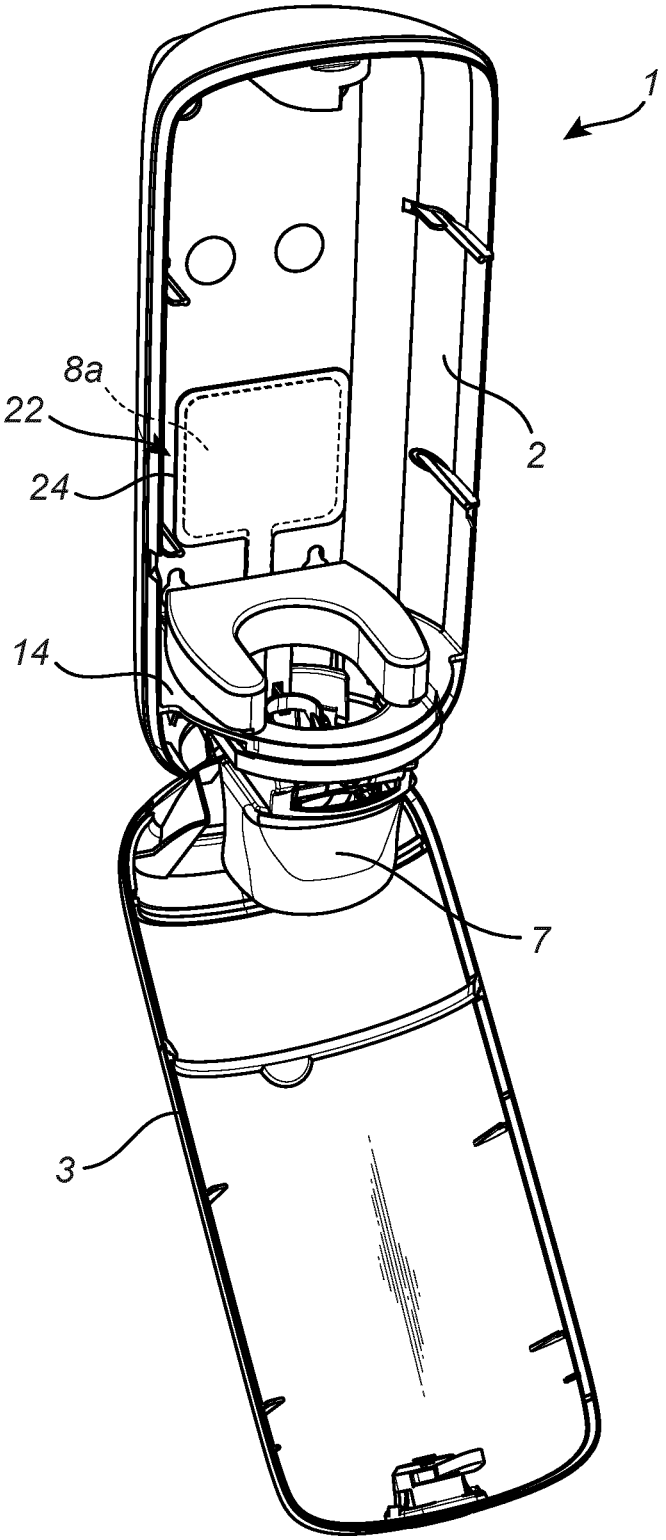
FIG. 8 shows a view of a dispenser and including the insert module of FIG. 7 which is mounted in the housing of the dispenser.

With reference to FIGS. 7 and 8, the dispenser system comprises a removeable insert module 22, which is configured to accommodate a replaceable liquid container 9 during operation of the dispenser system. The term "insert module" is used to describe a unit which can be positioned inside the housing 2 in a releasable and removable manner, i.e. temporarily or more permanently, i.e. for a relatively long time. Consequently, the insert module 22 may or may not form part of the dispenser system. The insert module 22 is shown separated from dispenser 1 in FIG. 7 and is shown in a condition in which it is positioned inside the housing 2 of the dispenser 1 in FIG. 8. Insert module 22 may be retrofitted into an existing dispenser in a simple manner in order to allow certain new functions to be implemented. In its most general form, the insert module 22 is used for accommodating a replaceable liquid container. This means for example that the insert module 22 can be configured for use with a replaceable liquid container and to that end may be positioned inside an existing dispenser. According to one embodiment, the insert module 22 can also be used with a replaceable liquid container, having its own individual transponder unit, in a dispenser of such type which is not equipped with any transponder reader unit.

In one embodiment, insert module 22 is configured to support and accommodate a replaceable liquid container 9 during operation of the dispenser 1. More precisely, the insert module 22 is first positioned in the housing 2, after which the liquid container 9 will be positioned in the insert module 22. In one embodiment, the insert module 22 is designed with a base portion 23 which is generally U-shaped and used for supporting a liquid container 9, and a rear portion 24 which is positioned to be placed behind the replaceable liquid container 9 during use of the dispenser 1.

In summary, insert module 22 is configured to be removably positioned in the dispenser. Furthermore, the dispenser comprises a dispensing mechanism which in one embodiment comprises a pump unit 11 which permits selective discharging of liquid. Also, the dispenser 1 comprises a replaceable liquid container 9 containing said liquid. Furthermore, the insert module 22 is configured for accommodating the liquid container 9, which leads to the advantages stated above.

Also, according to one embodiment, the dispenser 1 which is used together with the insert module 22 can also be configured as shown in FIGS. 1-4, i.e. with a transponder reader unit 8 which cooperates with a transponder unit 13 forming part of a replaceable liquid container 9.

According to a further embodiment shown in FIGS. 7 and 8, the insert module 22 is provided with a transponder reader unit 8*a* which is configured to cooperate with a transponder unit 13 carried by the liquid container 9, in a similar manner as described above with reference to transponder reader unit 8 shown in FIGS. 2, 3 and 4. In the embodiment shown in FIG. 7, the transponder reader unit 8*a* is positioned in the rear portion 24 of the insert module 22.

This means that the insert module 22 is suitable for use in a dispenser system which is not provided with any transponder reader unit and where there is a need for detecting a transponder unit 13 on the liquid container 9. In other words, a dispenser 1 which has not been manufactured with any transponder reader unit can be retrofitted with an insert module 22 (with the built-in transponder reader unit 8*a*) as shown in FIGS. 6 and 7. Such a dispenser 1 can then be used with a liquid container 9 having a transponder unit 13.

It should be noted that the dispenser 1 is configured to be operated either with the insert module 22 or without the insert module 22. The first case is particularly suitable if the dispenser 1 is not provided with any transponder reader unit. This can be relevant for example as regards alternative dispenser types which were not originally manufactured with the intention of being used with a liquid container having a transponder unit.

Furthermore, it should be noted that, in a specific, alternative embodiment, the insert module 22 is arranged without any transponder reader unit. Such an insert module 22 may be suitable in those cases in which the dispenser 1 itself already has a transponder reader unit 8, as shown in the embodiment of FIG. 2.

Consequently, the dispenser system as a whole comprises a transponder reader unit, either positioned in the housing or in the insert module (in case such an insert module is used). This means that the insert module 22 is removably arranged and that the dispenser system can be operated either with or without the insert module shown in FIG. 7.

The fact that the dispenser 1 comprises a transponder reader unit 8, 8*a* for detecting a transponder 13 should consequently be construed as meaning that either the insert module 22 or the dispenser 1 as such (i.e. suitably within the housing 2) may be equipped with such a transponder reader unit 8, 8*a*.

Furthermore, in the embodiment shown in FIGS. 7 and 8, the insert module 22 is provided with a detection unit 25 which is arranged for detecting the cumulative consumption of the contents of the replaceable liquid container 9. This is suitably implemented by detecting the operation of the pump unit 11. More specifically, the detection unit 25 is based on a generally C-shaped actuator 26 which is pivotally arranged in a bottom portion 27 of the insert module 22 and which is arranged for following the movement of the flange 17 of the pump unit 11 shown in FIGS. 5A and 5B. This is obtained through the fact that the C-shaped actuator 26 is configured for being positioned around the circumference of the pump unit 11 and will be forced in a vertical direction through movement of the flange 17. As will be described in greater detail below with reference to FIG. 9, the C-shaped actuator 26 can be used for detecting usage of the pump unit 11 and to transmit information regarding such usage to a microprocessor.

FIG. 8 shows the insert module 22 as mounted in the housing 2 of the dispenser 1, i.e so that the base portion 23 of the insert module 22 rests on the bottom surface 14 of the housing 2 and so that the bottom portion 27 extends through the opening 15 in the bottom surface 14.

Figure 9:
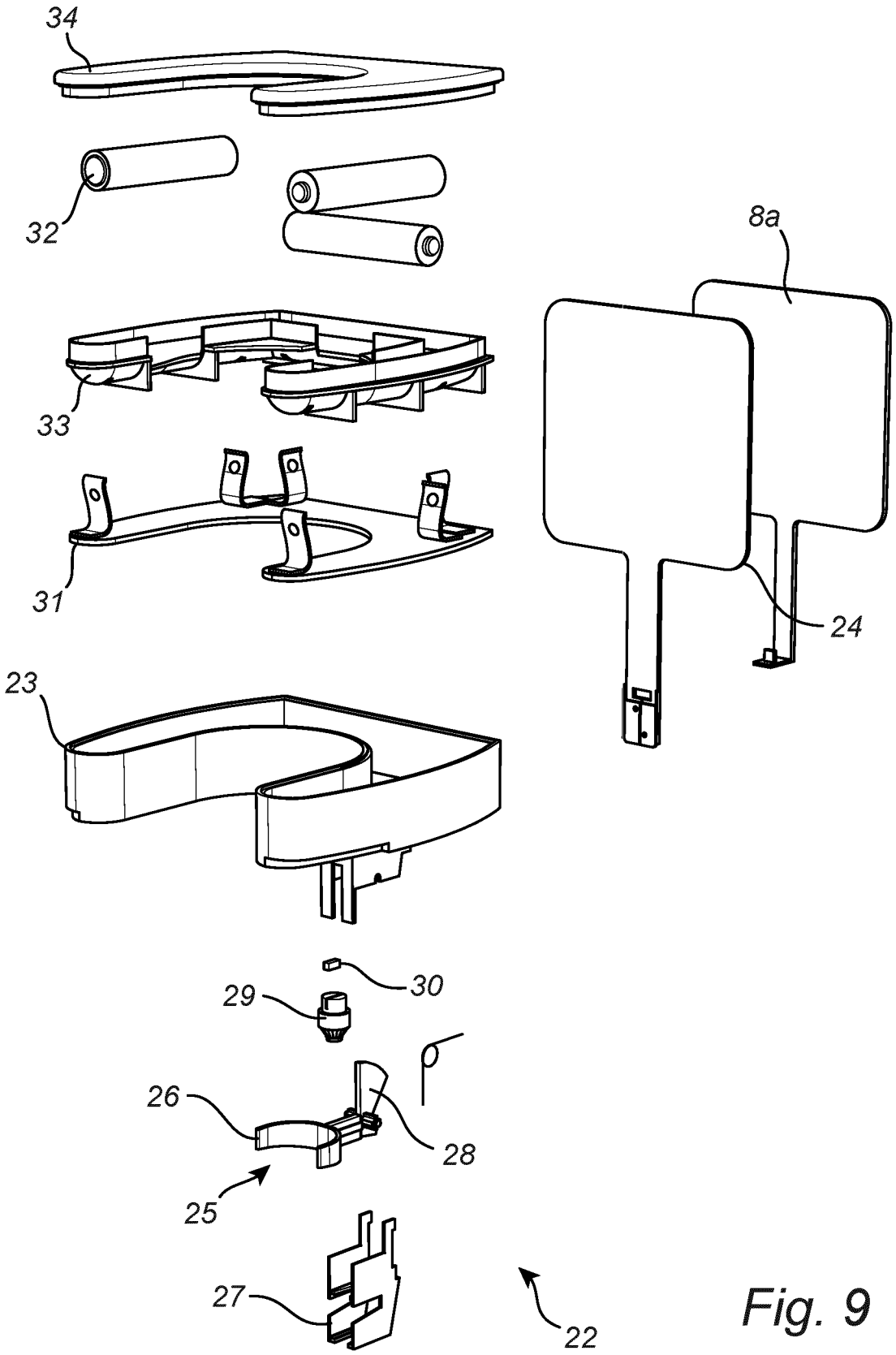
FIG. 9 shows the insert module from another angle, which in particular shows a detection device.

FIG. 9 shows the insert module 22 in greater detail. As mentioned above, the insert module 22 comprises a base portion 23 and a rear portion 24. The transponder reader unit 8*a* is integrated in the rear portion 24. Furthermore, the detection unit 25 is in the form of the generally C-shaped actuator 26 which is pivotally hinged in the bottom portion 27 which in turn is attached to the base portion 23.

In the embodiment of FIG. 9, the detection unit 25 has a gear portion 28 that meshes with a rotating gear element, which according to the embodiment is constituted by a gear wheel 29 disposed in the base portion 23 in a manner so that it may rotate about a generally vertical axis (in the illustrative orientation shown in FIG. 9). Furthermore, any pivoting motion of the C-shaped actuator 26—which is caused by actuation of the pump unit 11—will act so that the gear portion 28 forces the gear wheel 29 to rotate in a direction which corresponds to the direction of pivotal movement of the actuator 26.

The gear wheel 29 is arranged so as to cooperate with a suitable sensor, for example a Hall sensor, which is a type of magnetometer sensor based on a magnetic sensor which senses the presence of a magnetic field as generated by a permanent magnet 30.

According to an embodiment, the sensor comprises a 2-dimensional or 3-dimensional Hall effect sensor that measures the orthogonal magnetic fields in the rotational plane of the magnet. When the magnet rotates during the actuation of the dispenser, the ratio of magnetic field strength among the measured dimensions changes and this ratio is used to determine the rotation angle of the magnet.

The magnet sensor is not shown as such in FIG. 9 but is suitably arranged as a separate unit in the insert module 22, for example in a printed circuit board 31 which is positioned in the base portion 23. Furthermore, the insert module 22 comprises a compartment for a number of batteries 32, which are enclosed by means of a lower section 33 and an upper section 34. The lower section 33 covers the printed circuit board 31.

Consequently, the magnetic sensor is positioned on the printed circuit board 31 which is enclosed within a waterproof compartment (defined by the base portion 23 and the lower section 33), whereas the magnet 30 is arranged outside said waterproof compartment.

The actuating device 7 shown for example in FIGS. 5A, 5B and 8 is displaced directly by a user by means of a pushing motion. Consequently, the actuating device 7 translates a displacement effected by the user into a movement of the detection unit 25 which corresponds to the displacement of the pump unit 11 and also to the amount of liquid which has been dispensed. The actuation device 7 (see FIGS. 5A and 5B) is indirectly connected to the detection unit 25. More precisely, the movement of the actuation device 7 causes the flange 17 of the pump unit 11 to be displaced. This movement in turn causes the C-shaped actuator 26 to pivot as described above. Consequently, the actuation device 7 and the detection unit 25 interact through this indirect connection.

This means that the detection unit 25 can be used for measuring the actual cumulative amount of liquid which has been dispensed from the liquid container 9. Such information is suitably combined with information regarding the points in time at which dispensing has occurred, i.e. when a user has pushed on the actuating device 7.

Figure 10:
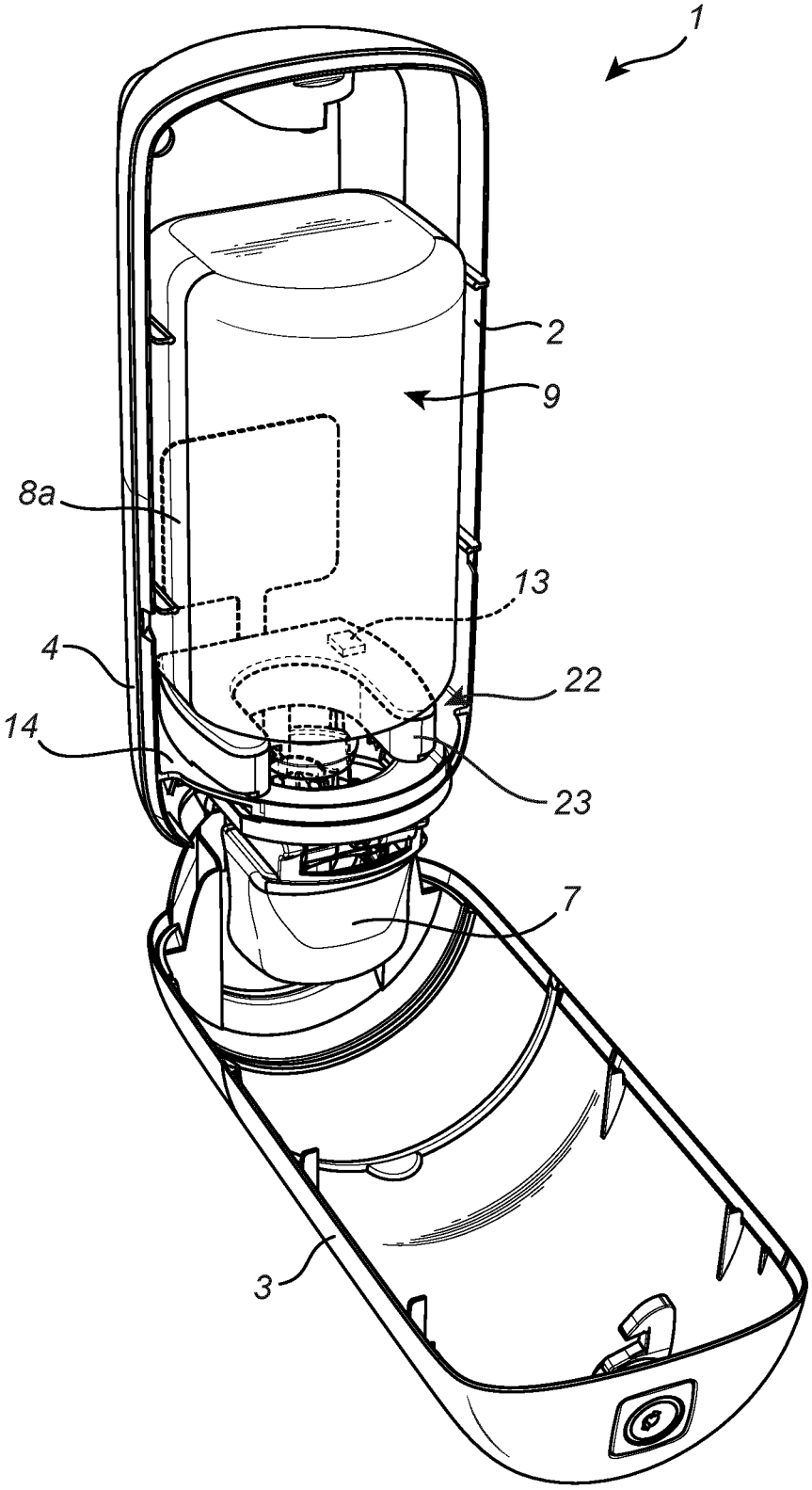
FIG. 10 shows a view corresponding to FIG. 8 with a dispenser system including a replaceable liquid container which is mounted in and supported by the insert module.

FIG. 10 shows an embodiment in which the insert module 22 has been positioned in the housing 2. Next, the replaceable container 9 is positioned in the insert module 22 in a manner so that the pump unit 11 extends through the "U" shaped space defined by the base portion 23. Also, the pump unit 11 is positioned so that the C-shaped actuator 26 of the detection unit 25 is positioned around a part of the circumference of the pump unit 11. This means that when a user pushes on the actuator 7, the pump unit 11 will be displaced as described with reference to FIGS. 5A and 5B, i.e. so that the flange 17 is forced upwards. This also means that the C-shaped actuator 26 is pivoted upwards. By means of the gear portion 28 of the actuator 26 which meshes with the gearwheel 29 (see FIG. 9), detection of the movement of the pump unit 11 can be obtained.

The displacement of the pump unit 11 as actuated by users of the dispenser 1 is detected by the detection unit 25. By means of information regarding the liquid container 9, for example regarding the pump type and the type of liquid in the container 9, which has been obtained by reading the transponder unit 13, the cumulative amount of displacement of the pump unit 11 can be translated into a precise measurement of the consumption of the liquid container 9. This translation can be carried out through the use of previously stored information regarding a nominal amount of liquid which is dispensed for each actuation of the dispenser or which amount of liquid corresponds to a given displacement of the pump unit 11.

Figure 11:
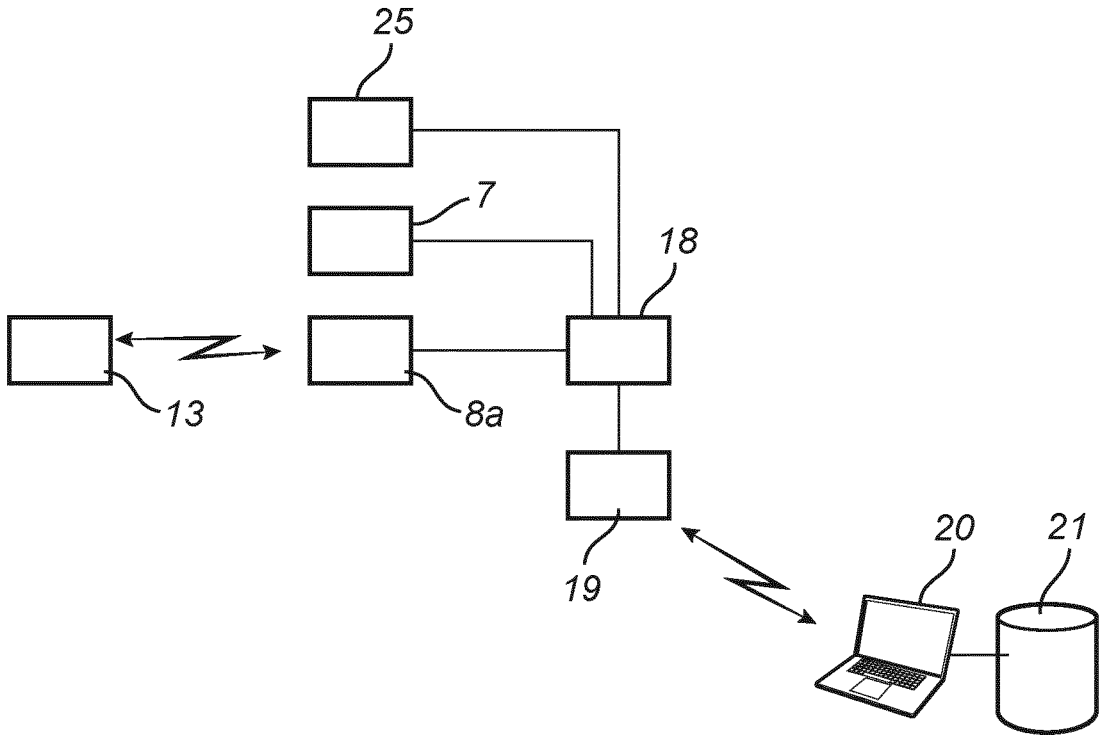
FIG. 11 is a schematic drawing of a system for detection of the consumption of the liquid container according to a further embodiment.

FIG. 11 shows a simplified schematic drawing of a system corresponding to the dispenser system according to FIGS. 7 and 8, i.e. including the insert module 22 which is configured for accommodating a liquid container (not shown in FIG. 11). More precisely, the illustrated embodiment relates to a use of the transponder unit 13 which can be detected by means of the transponder reader unit 8*a*, which is operatively connected to a microprocessor 18. Also, the actuation unit 7 is operatively connected to the microprocessor 18 in the same general manner as described with reference to FIG. 6, i.e. so that a signal is generated and transmitted to the microprocessor 18 when a user activates the dispenser 1.

In one embodiment, the detection unit 25 is operatively connected to the microprocessor 18. In this manner, a signal corresponding to the usage, i.e. the cumulative dispensed amount of liquid in the liquid container 9, can be generated when the actuation device 7 is activated by a number of users. Information defining the cumulative dispensed amount of liquid can be derived from the total displacement of the pump unit 11, as detected by the detection unit 25 and measured by the Hall sensor.

Data regarding such usage can be transmitted to the microprocessor 18. This means that the cumulative amount of soap that has been dispensed can be calculated by means of the microprocessor 18. Data related to the usage of soap can furthermore be transmitted from the microprocessor 18 and to an external computer unit 20 via a communications unit 19.

By means of the system as described above, the insert module 22 is configured so that a number of processes for detecting and tracking usage of the dispenser 1 can be implemented. First, the external computer unit 20 can be configured for calculating the cumulative usage of liquid in each liquid container 9 with which computer unit 20 communicates. This means that the external computer unit 20 can be configured for sending alert messages and instructions to maintenance staff when it has detected that a particular replaceable liquid container 9 is empty or close to empty.

The calculation of the cumulative usage of liquid may depend on information related to the volume of the liquid container in question or the type of liquid used. Such information can be stored in the transponder unit 13. In general terms, the transponder unit 13 can be used to store information about each liquid container 9, as regards for example its manufacturing date, ingredients, shelf life, usage, waste instructions and more.

The detection unit 25 is based on a magnetometer sensor which provides a highly accurate measurement of the movement of the actuator 26, which in turn yields an accurate measurement of the liquid used.

Furthermore, data from a large number of liquid containers can be used for collecting statistics regarding the use of the dispensers, for example for determining whether certain dispensers are used more frequently than others and for determining the overall consumption of liquid at a particular site, such as a hospital or airport. Also, the average use of liquid for each dispenser which is connected to the external computer unit 20 can be determined.

Also, information regarding the usage of liquid can be combined with other information which can be programmed on the transponder unit 13, for example which type of liquid is in the liquid container 9. This means that statistics regarding the usage of different types of liquids can be obtained.

Furthermore, the dispenser 1 can be configured for recognizing whether the liquid container 9 is of a particular brand, by checking (by means of the external computer unit 20 and the memory unit 21) whether the identity of the liquid container 9 is included in a pre-stored database of approved liquid containers.

Also, the dispenser can be configured to recognize whether the liquid container 9 is a full, unused liquid container by checking, in the external computer unit 20, whether the identity of the liquid container corresponds to a unit which has not been used before.

Furthermore, the dispenser can be configured for displaying information related to the contents of an individual liquid container, e.g., type of fluid, volume, suitably on a display which is provided on the dispenser (not shown in the drawings).

Also, the information which is transmitted from the dispenser could comprise time stamp information, i.e. information on when a dispenser has been activated by a user. This means that information regarding when the liquid container needs to be replaced could be calculated both depending on cumulative usage data as well as depending on the intensity of the user traffic associated with the dispenser.

The insert module 22 is not limited to the embodiments described above but can be varied. For example, the insert module 22 can be arranged either with or without a transponder reader unit, depending on its intended use. Also, the insert module 22 can be arranged either with or without a detection unit.

Although the described embodiments relate to an insert module 22 which is intended to be used with a liquid container 9 which contains soap, it should be noted that other liquids are alternatively contemplated, such as detergent, disinfectants, skin-care liquids, moisturizers, sanitizers, lotions, shampoo and other medicaments. The choice and composition of the liquid can be varied by the skilled person depending on the properties needed for the liquid and the desired result.

Also, the actuating device can be either a manually operated or a motorized type. In the embodiment of FIG. 4, for example, the actuating device is manually operated by a user. In another embodiment, the actuating device can be motorized, which means that an electric motor is activated so as to operate the pump unit when a user pushes on the actuating device. Also, the actuating device can be automatic, i.e. based on a touch-free sensor, for example based on infrared technology, which senses the presence of a user and activates an electric motor when a user has been detected.

The invention claimed is:

1. A system for a dispenser configured to accommodate a replaceable liquid container therein, the system comprising:

an insert module configured to be removably positioned in the dispenser and to cooperate with a pump that transfers liquid to be discharged from the replaceable liquid container; and a microprocessor arranged in the insert module and configured to communicate with an external computer unit, wherein the insert module is configured to support the replaceable liquid container, wherein the insert module comprises a transponder reader unit that is connected to the microprocessor and that is configured to cooperate with a transponder unit on the replaceable liquid container to obtain unique identification data from the replaceable liquid container, wherein the insert module comprises a detection unit configured to cooperate with the pump to detect a cumulative consumption of contents of the replaceable liquid container, the cumulative consumption indicating whether the replaceable liquid container needs to be replaced, and wherein the microprocessor is configured to communicate the unique identification data and the cumulative consumption to the external computer.

2. The system according to claim 1, wherein said transponder reader unit is arranged for obtaining stored data from said transponder unit corresponding to a unique identity of said replaceable liquid container.

3. The system according to claim 1, wherein the transponder reader unit is an RFID reader unit and the transponder unit is an RFID tag.

4. The system according to claim 1, wherein the detection unit comprises a magnetometer sensor.

5. The system according to claim 1, wherein the detection unit is configured to be actuated by an actuating device of the dispenser.

6. The system according to claim 1, wherein the detection unit comprises an actuator which is configured to be displaced by the pump to detect the cumulative consumption.

7. The system according to claim 6, wherein the actuator comprises a geared element which meshes with a rotating gear element which is arranged in said insert module.

8. The dispenser according to claim 1, further comprising a foam pump unit for discharging the liquid in said replaceable liquid container as foam.

9. A method for using the system of claim 1, comprising:

disposing the insert module in the dispenser;

positioning the replaceable liquid container in the dispenser supported by the insert module.

10. The method according to claim 9, further comprising:

using the transponder reader unit of the insert module to read the unique identification data from the transponder unit on said replaceable liquid container.

11. The method according to claim 9, further comprising:

detecting the cumulative consumption of the contents of said replaceable liquid container by the detection unit; and indicating whether said replaceable liquid container needs to be replaced.

12. The method according to claim 11, further comprising:

detecting the cumulative consumption of the contents of the replaceable liquid container by actuating the pump and the actuating the pump pivotally displacing an actuator of the insert module.

13. A system comprising:

a dispenser comprising a housing configured to accommodate a replaceable liquid container therein;

an insert module removably positioned at least partially in the housing and configured to cooperate with a pump that transfers liquid to be discharged from the replaceable liquid container; and a microprocessor arranged in the insert module and configured to communicate with an external computer unit, wherein the insert module is configured to support the replaceable liquid container, wherein the insert module comprises a transponder reader unit that is connected to the microprocessor and that is configured to cooperate with a transponder unit on the replaceable liquid container to obtain unique identification data from the replaceable liquid container, wherein the insert module comprises a detection unit configured to cooperate with the pump to detect a cumulative consumption of contents of the replaceable liquid container, the cumulative consumption indicating whether the replaceable liquid container needs to be replaced, and wherein the microprocessor is configured to communicate the unique identification data and the cumulative consumption to the external computer.

* * * * *